US008408579B2

(12) United States Patent
Bourgier et al.

(10) Patent No.: US 8,408,579 B2
(45) Date of Patent: Apr. 2, 2013

(54) SKI

(75) Inventors: Aldric Bourgier, Vieugy (FR); Jean-Philippe Guex, Cran-Gevrier (FR); Patrick Metral, Annecy le Vieux (FR); Lionel Favret, Annecy (FR)

(73) Assignee: Salomon S.A.S., Metz-Tessy (FR)

( * ) Notice: Subject to any disclaimer, the term of this patent is extended or adjusted under 35 U.S.C. 154(b) by 141 days.

(21) Appl. No.: 11/943,999

(22) Filed: Nov. 21, 2007

(65) Prior Publication Data

US 2008/0116662 A1 May 22, 2008

(30) Foreign Application Priority Data

Nov. 22, 2006 (FR) ..... 06 10280

(51) Int. Cl.
*A63C 5/04* (2006.01)

(52) U.S. Cl. ..... 280/609

(58) Field of Classification Search ..... 280/14.21, 280/14.22, 28.14, 600, 601, 602, 608, 609, 280/610; 441/68, 74
See application file for complete search history.

(56) References Cited

U.S. PATENT DOCUMENTS

| | | | | | |
|---|---|---|---|---|---|
| 1,569,885 | A | * | 1/1926 | Robblee | 280/25 |
| 3,111,695 | A | * | 11/1963 | Kelly, Jr. | 441/74 |
| 3,134,992 | A | * | 6/1964 | Tyll | 441/70 |
| 3,148,392 | A | * | 9/1964 | Bennett | 441/68 |
| 3,212,787 | A | * | 10/1965 | Werntz | 280/609 |
| 3,827,096 | A | * | 8/1974 | Brownson | 441/68 |
| 4,085,947 | A | | 4/1978 | Sarver et al. | |
| 5,275,428 | A | * | 1/1994 | Bejean et al. | 280/602 |
| 5,344,176 | A | * | 9/1994 | Trimble | 280/602 |
| 5,375,868 | A | * | 12/1994 | Sarver | 280/609 |
| 5,413,371 | A | * | 5/1995 | Trimble | 280/602 |
| 5,435,588 | A | * | 7/1995 | Commier et al. | 280/602 |
| 5,667,238 | A | * | 9/1997 | Sarver | 280/609 |
| 5,687,983 | A | * | 11/1997 | Feketa et al. | 280/609 |

(Continued)

FOREIGN PATENT DOCUMENTS

| | | |
|---|---|---|
| DE | 285 338 C | 6/1915 |
| EP | 1 925 344 B1 | 3/2011 |

(Continued)

OTHER PUBLICATIONS

Translation—FR 2786108.*

(Continued)

*Primary Examiner* — Katy M Ebner
*Assistant Examiner* — Brodie Follman
(74) *Attorney, Agent, or Firm* — Greenblum & Bernstein, P.L.C.

(57) ABSTRACT

Ski adapted to receive a skier's boot, the ski having a front tip, a rear end, front and rear contact lines, and a central zone between the front tip and the rear end. The distance separating the forward contact line and the ski tip is greater than or about 500 mm. The shovel, located between the front tip and the forward contact line has a convex zone which includes a first shovel portion having a lateral profile extending between an arc of circle with a 9-meter radius and an arc of circle with a 5-meter radius; a second shovel portion contiguous with the first shovel portion and having a lateral profile extending between an arc of circle with a 9-meter radius and an arc of circle with a 1-meter radius; a third shovel portion contiguous to the second shovel portion and extending to the front tip of the ski.

31 Claims, 5 Drawing Sheets

U.S. PATENT DOCUMENTS

| | | | | |
|---|---|---|---|---|
| 5,954,356 | A * | 9/1999 | Busby et al. | 280/602 |
| 6,158,747 | A * | 12/2000 | Magnani | 280/11.14 |
| 6,352,268 | B1 * | 3/2002 | Peart | 280/14.21 |
| 6,986,525 | B2 | 1/2006 | Liard | |
| 7,083,183 | B2 * | 8/2006 | Spanier et al. | 280/602 |
| 7,243,927 | B2 * | 7/2007 | Takahiko | 280/28 |
| 7,341,271 | B2 * | 3/2008 | Bunter | 280/602 |
| 7,510,206 | B2 * | 3/2009 | Walker | 280/600 |
| 7,559,571 | B2 * | 7/2009 | Quaggiotti | 280/602 |
| 7,690,674 | B2 * | 4/2010 | Trimble et al. | 280/609 |
| 7,798,514 | B2 * | 9/2010 | Canaday et al. | 280/609 |
| 7,823,892 | B2 * | 11/2010 | Olson et al. | 280/14.22 |
| 2002/0041080 | A1 | 4/2002 | Moriyama et al. | |
| 2002/0089149 | A1 * | 7/2002 | Barbieri et al. | 280/609 |
| 2005/0212258 | A1 * | 9/2005 | Enders | 280/602 |
| 2006/0057912 | A1 * | 3/2006 | Brind | 441/68 |
| 2008/0042400 | A1 * | 2/2008 | Smith et al. | 280/609 |
| 2008/0106068 | A1 * | 5/2008 | Drake et al. | 280/601 |
| 2008/0116662 | A1 | 5/2008 | Bourgier et al. | |
| 2008/0272575 | A1 * | 11/2008 | Olson et al. | 280/609 |

FOREIGN PATENT DOCUMENTS

| | | | |
|---|---|---|---|
| FR | 2 786 108 | A1 | 5/2000 |
| FR | 2786108 | A1 * | 5/2000 |
| FR | 2 908 665 | A1 | 5/2008 |

OTHER PUBLICATIONS

Heinz, Polednik: "Weltwunder Skisport," 1969, Verlag Welsermühl, Wels, XP002448803, p. 80.

* cited by examiner

SKI

CROSS-REFERENCE TO RELATED APPLICATION

This application claims priority under 35 U.S.C. §119 of French Patent Application No. 06 10280, filed on Nov. 22, 2006, the disclosure of which is hereby incorporated by reference thereto in its entirety.

BACKGROUND OF THE INVENTION

1. Field of the Invention

The present invention relates to snow gliding skis.

2. Description of Background and Other Information

To be usable on different types of snow, a ski generally has a substantial length, on the one hand, and a variable width, on the other hand, the central zone being generally narrower than the end zones.

When a skier skis on powder snow with skis primarily designed for use on packed snow, he is forced to modify his manner of skiing, especially his body position. An efficient and safe technique requires a forward position, whereby the skier is said to be "engaging the slope". However, when the skier is on powder snow, he must move his body rearwardly to prevent the front of the skis from digging too much into the snow.

In order to improve their use on powder snow, certain areas of the skis have been proposed to be widened and the length of the shovel, at the front of the ski, has been proposed to be increased, shovel length being defined in the direction of the length of the ski between the front end of the ski and the front contact line, namely, the contact line which the ski would have when placed on a planar, or flat, surface.

The document FR 2 786 108 discloses such a ski in which the front and rear contact lines are closer to the boot than they are in a conventional ski. In addition, the shovel of such ski is significantly raised, the profile of the shovel being made of a succession of portions that all have radii of curvature less than 3 meters (m). The use of such a ski on powder snow is thereby enhanced, although the use of such a ski on packed snow is made much more difficult. Furthermore, in such a ski, the succession of shovel portions, each of which has a radius of curvature that is different but close in value to that of adjacent portions, causes the visual perception of the shovel to be reduced. However, it has been noted that the visual perception of the shovel, i.e., a raised area at the front of the ski, is a psychological factor which inspires confidence in the skier. Indeed, one can understand that the skier will not fear being stopped or destabilized by a low obstacle if he knows that the ski has a raised shovel.

Furthermore, in cases where skis are made flat and then bent to form a shovel, the shovel lacks continuity because it is made by a succession of portions having a straight profile connected together by angular zones. In this case, there is no tangency between the profile of the shovel and the profile of the central portion of the ski, on the one hand, and between the profiles of the various shovel portions, on the other hand. If such a construction were to be considered as having no disadvantage for skis having modestly sized shovels, it becomes a problem in terms of stability and skiability with longer shovels. Furthermore, when a ski has a large shovel made according to the method of bending the front of the ski, the presence of more or less prominent "flat portions" can be noticed. "Flat portions" refers to each portion of the bottom surface whose profile is comparable to a straight line. To detect the presence of "flat portions", one lays the ski on a planar surface and then lifts the tail of the ski so that the contact point between the bottom surface and the planar surface moves from the front contact line to the end of the ski. This is a rolling movement of the bottom surface on a planar surface. During this rolling movement, as soon as the contact between the bottom surface and the planar surface is no longer a mere transverse line relative to the longitudinal direction of the ski, but a surface, this surface can be regarded as a "flat portion". The more substantial a "flat portion", the more it negatively affects the behavior of the ski, particularly the stability of the ski.

Conversely, a ski with no "flat portion" has a better, more stable behavior with more grip. Furthermore, when one skis on powder snow, having a "flat portion" in the area of the shovel can cause the snow to accumulate in the area of this "flat portion", which can create a blockage.

SUMMARY OF THE INVENTION

The present invention provides a ski that can overcome the limitations of known prior art devices. More particularly, the invention provides a ski whose behavior is optimal both on powder snow and on trails with packed snow.

In addition, the invention improves the ski behavior on packed snow.

The invention is directed to a ski adapted to receive a user's boot and having a front tip S, a rear end T, and a central zone located between the front tip and the rear end and which, when placed on a planar surface, comprises at least two contact lines with the planar surface, namely, the forward contact line LS located in the vicinity of the front tip, on the one hand, and the rear contact line LT located in the vicinity of the rear end, on the other hand, the distance DS separating the forward contact line LS from the ski tip S being greater than 500 mm (millimeters), i.e., DS>500 mm.

In a particular embodiment, the portion located between the front tip S and the forward contact line LS, i.e., the shovel, is made as a convex area, which includes:

a first shovel portion whose lateral profile is comprised between a circular arc having a 9-meter radius and a circular arc having a 5-meter radius;

a second shovel portion adjoining the first shovel portion and having a profile comprised between a circular arc having a 9-meter radius and a circular arc having a 1-meter radius;

a third shovel portion adjoining, or contiguous with, the second shovel portion and extending up to the front tip of the ski.

In a particular embodiment, the profile of the first and second shovel portions has no "flat portion."

Further, according to a particular embodiment, the profile of the first and second shovel portions is such that, with any pair of points P1 and P2 placed at a 150-mm-chord distance from one another on the curve reproducing the lateral profile of the shovel, there is at least one point of the curve between P1 and P2 which is more than 0.5 mm away from the chord joining P1 to P2.

In a particular embodiment of the invention, the first shovel portion has the shape of a circular arc having a radius R1 comprised between 5 m and 9 m, and the second shovel portion has the shape of a circular arc having a radius R2 comprised between 3 m and 1 m.

In a particular embodiment of the invention, the third shovel portion has a length comprised between 80 mm and 130 mm.

In a particular embodiment, the height H, which corresponds to the distance separating the planar surface from the ski measured at a point 300 mm away from the front ski tip, is comprised between 5 mm and 25 mm, i.e., 5 mm<H<25 mm.

In an embodiment of the invention, the distance DT separating the rear contact line LT from the rear end T is less than 300 mm, i.e., DT<300 mm.

BRIEF DESCRIPTION OF DRAWINGS

The invention will be better understood from the description that follows, with reference to the attached drawings, in which.

DETAILED DESCRIPTION OF THE INVENTION

Figure 1:
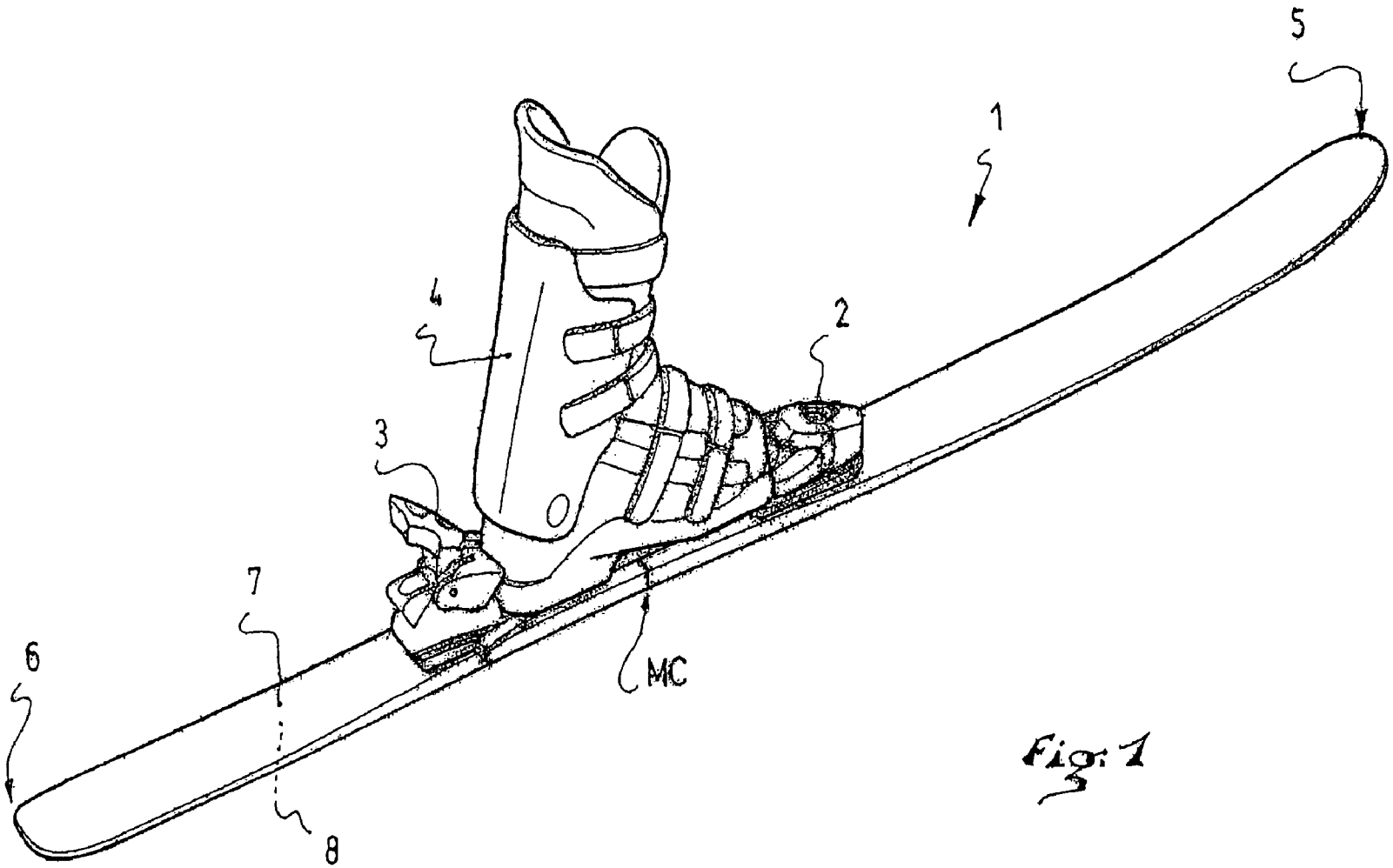
FIG. 1 is a general perspective view of a ski according to the invention provided with devices for retaining a boot.

The ski 1 according to the invention is an elongated structure which extends from a front tip 5 to a rear end 6. The lower surface 8, or bottom surface, is generally flat and is adapted to glide on the snow. The top surface 7 is also generally flat but can have various projections or unevenness.

The central zone (or central portion) of the ski includes a line, i.e., the center line MC of the boot. This line corresponds to the recommended location for the middle of the boot 4 when the boot is positioned between the bindings, which are fixed on either side of the middle line MC of the boot.

The bindings, or retaining means, comprise a front abutment 2, or toe piece, positioned forward of the line MC and the rear abutment 3, or heel piece, positioned rearward of the line MC. Together, the toe and heel pieces 2, 3 retain the boot 4 on the ski.

Figure 2:
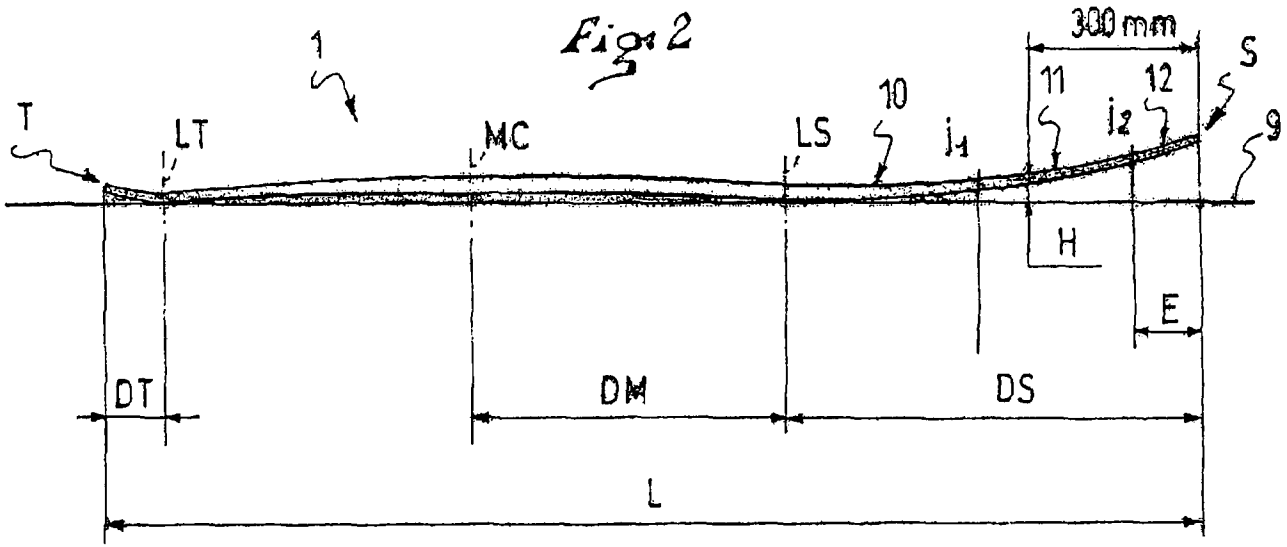
FIG. 2 is a side view of the ski of FIG. 1.

FIG. 2 is a side view of the ski 1, shown in a non-stressed state (i.e., a static, not being used by the skier) and resting on a planar/flat surface 9. Two ski portions, one at the front and one at the rear, are in contact with the planar surface 9. These contact zones are in fact two lines, i.e., the front contact line LS and the rear contact line LT, respectively. Between these two contact lines, the ski has a concave curvature called the camber. Furthermore, it is between these two contact lines that the aforementioned binding elements are fixed.

Beyond the front contact line LS, the ski portion extending from the front contact line LS to the front tip S is called the shovel. The shovel length DS corresponds to the distance separating the front contact line LS from the front tip S. According to the invention, this length is greater than 500 mm. In the example shown, the overall ski length L equals 1920 mm and the length DS equals 730 mm.

The substantial length of the shovel reduces the risk of having the ski dig into the snow when skiing on powder snow. However, even when skiing beyond a trail on powder snow, the skier is able to position his body forwardly and to maintain a position that is similar to his position when skiing on a packed-snow trail.

The position of the front contact line LS is such that the distance DM that separates it from the boot middle line MC is greater than 300 mm.

The ski portion positioned between the rear contact line LT and the rear end T defines what is referred to as the ski tail. In the ski of the invention, the tail is much shorter than the shovel. The rear contact line LT is positioned at a distance DT from the rear end T of the ski, which is less than 300 mm. In the example shown, this distance equals 100 mm.

Figure 3:
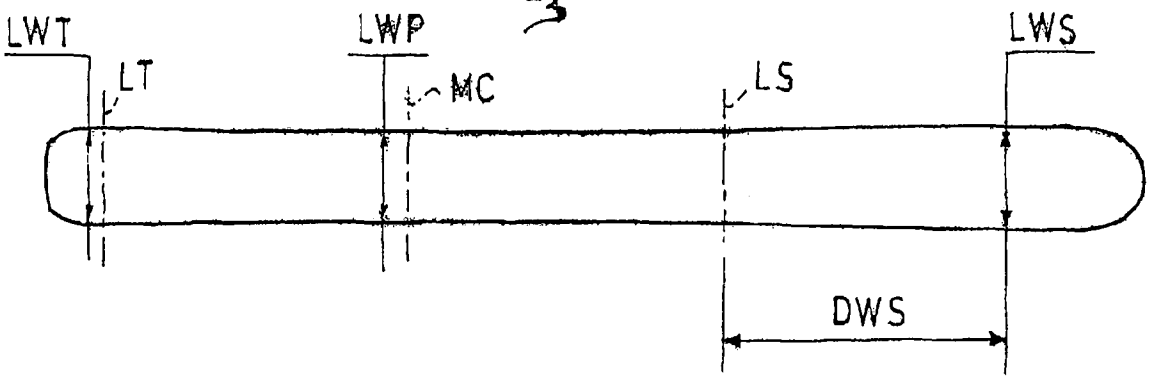
FIG. 3 is a bottom view of the ski of FIG. 1.

FIG. 3 is a top view of the ski of FIGS. 1 and 2, which shows the respective positions of the front and rear contact lines, LS and LT, and of the middle line MC of the boot, as well as the lines corresponding to the width of the shoulder and the width of the heel of the ski as well as the width of the waist of the ski.

The line of the width of the waist of the ski, LWP, is positioned in the vicinity of the boot middle line, set back with respect to the latter. The ski width in the area of this line is commonly called the waist width. The waist width is comprised between 100 and 150 mm, or between about 100 and about 150 mm. In the example shown, the width of the waist of the ski is 127 mm.

The line of the width of the heel of the ski, LWT, is located in the vicinity of the rear contact line LT between the latter and the rear end T of the ski. The line LWT can also be situated exactly in the area of the rear contact line LT. The ski width is measured on this line and is commonly referred to as the tail width. The tail width is comprised between 110 and 160 mm. In the example shown, the tail width equals 137 mm.

The line of the width of the shoulder of the ski, LWS, is located between the front end of the ski and the front contact line LS at a distance DWS from the latter. The distance DWS is comprised between 440 mm and 640 mm. In the example shown, it measures 540 mm. The ski width on this line is commonly referred to as the shovel width. The shovel width is comprised between 125 mm and 170 mm. In the example shown, it measures 147 mm.

When the ski is flat on the snow, the bottom edges in contact with the snow are limited to the running edges located between the rear contact line LT and the front contact line LS. When the ski is no longer flat on the snow and the skier edges, the contact length increases up to a maximum defined by the distance separating the line of the width of the ski shoulder LWS from the width of the ski heel LWT.

In the ski of the invention, the distance between the lines of maximum width is much more substantial than that between the front and rear contact lines. Due to this, as soon as the skier initiates a turn and edges, the length of the edge gripping the trail is more substantial.

Figure 4:
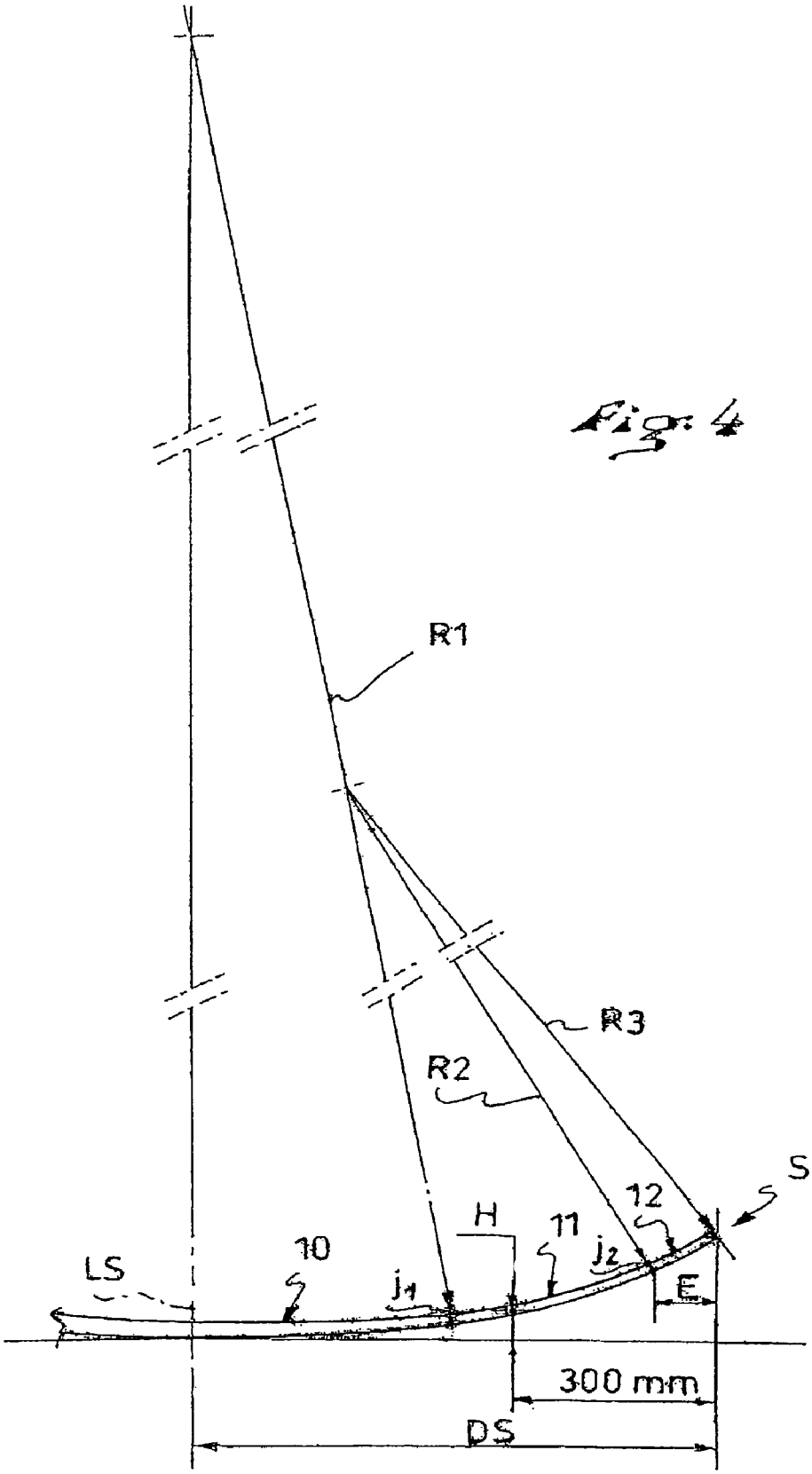
FIG. 4 is a partial side view of the ski of FIG. 1.

FIG. 4 shows a side view of the ski shovel in the non-limiting illustrated embodiment. From the front contact line LS up to the front end S, it is made of three portions. The first shovel portion 10 is contiguous and tangent to the central portion of the ski. It has a slightly convex lateral profile. Due to this very small convexity, the curvature of the ski lateral profile has a better continuity in the area of the junction between the central portion of the ski and the shovel.

For example, a lateral profile of this portion can be given a shape in the form of an arc of circle whose radius R1 is comprised between 4 m and 9 m. In this case, in the example shown, the radius R1 equals 6 m.

Choosing a circular arc shape ensures a better continuity from the central portion to the ski tip, than if the shape of the shovel were to be made of straight line portions. In addition, the profiles of the central portion and shovel are strictly tangent in the area of the front contact line LS.

The choice of a circular arc shape is non-limiting within the scope of the invention. Other profiles are possible, provided they fit in the space comprised between two arcs of a circle extending through the point LS and the tangent, in the area of this point, to the profile of the ski central portion. The two circular arcs are one arc of a circle with a 9-meter radius, on the one hand, and a circular arc having a 5-meter radius, on the other hand. Furthermore, reference is made to the point LS, although LS was designated hereinabove as being the front contact line. This is not a contradiction insofar as when considering the lateral profile of the ski, the line LS represents a point.

The profile of the first shovel portion 10 extends from the point LS to the intermediate point J1 of the shovel profile. That is, the point J1 is the forward end of the profile of the first shovel portion 10.

The second shovel portion 11 is contiguous and tangent to the first shovel portion 10. It has a lateral profile having a greater convexity. For example, the second shovel portion 11 can be given a lateral profile in the form of a circular arc having a radius R2 comprised between 1 m and 9 m or, in a particular embodiment, between 1 m and 3 m. In this particular case, i.e., in the example shown, the radius R2 equals 1.5 m.

For the second shovel portion 11, the choice of a circular arc shape is non-limiting within the scope of the invention. Other profiles are possible as long as they fit in the space comprised between two arcs of a circle extending through the point J1 and tangent, in the area of this point, to the profile of the first shovel portion 10. The two circular arcs involved are a circular arc having a 9-meter radius, on the one hand, and a circular arc having a 1-meter radius, on the other hand.

The profile of the second shovel portion 11 extends from the intermediate point J1 of the shovel profile to the intermediate point J2 of the shovel profile. That is, the point J2 is the forward end of the profile of the second shovel portion 11.

Because its convexity is very small, the first shovel portion 10 is hardly visible, except when the ski rests on a planar surface and it is viewed from the side. Because the second shovel portion can have a greater convexity, it can be more visible and improve the skier's visual perception of the shovel.

The first and second portions of the shovel can be chosen to have the same convexity, such as a shovel whose profile has only one radius with a curvature R1.

In all cases, and in order to further improve the skier's visual perception of the shovel, the third shovel portion 12 can have an even greater curvature. The third shovel portion 12 is the end portion of the shovel. It is contiguous and tangent to the second shovel portion 11, and its length E is comprised between 80 mm and 130 mm. In the example shown, the length E of the third shovel portion is 120 mm and is measured from the end S of the ski.

The profile of the third shovel portion can have the shape of a circular arc having a radius R3, whereby $R3 \leqq R2 \leqq R1$.

Figure 5:
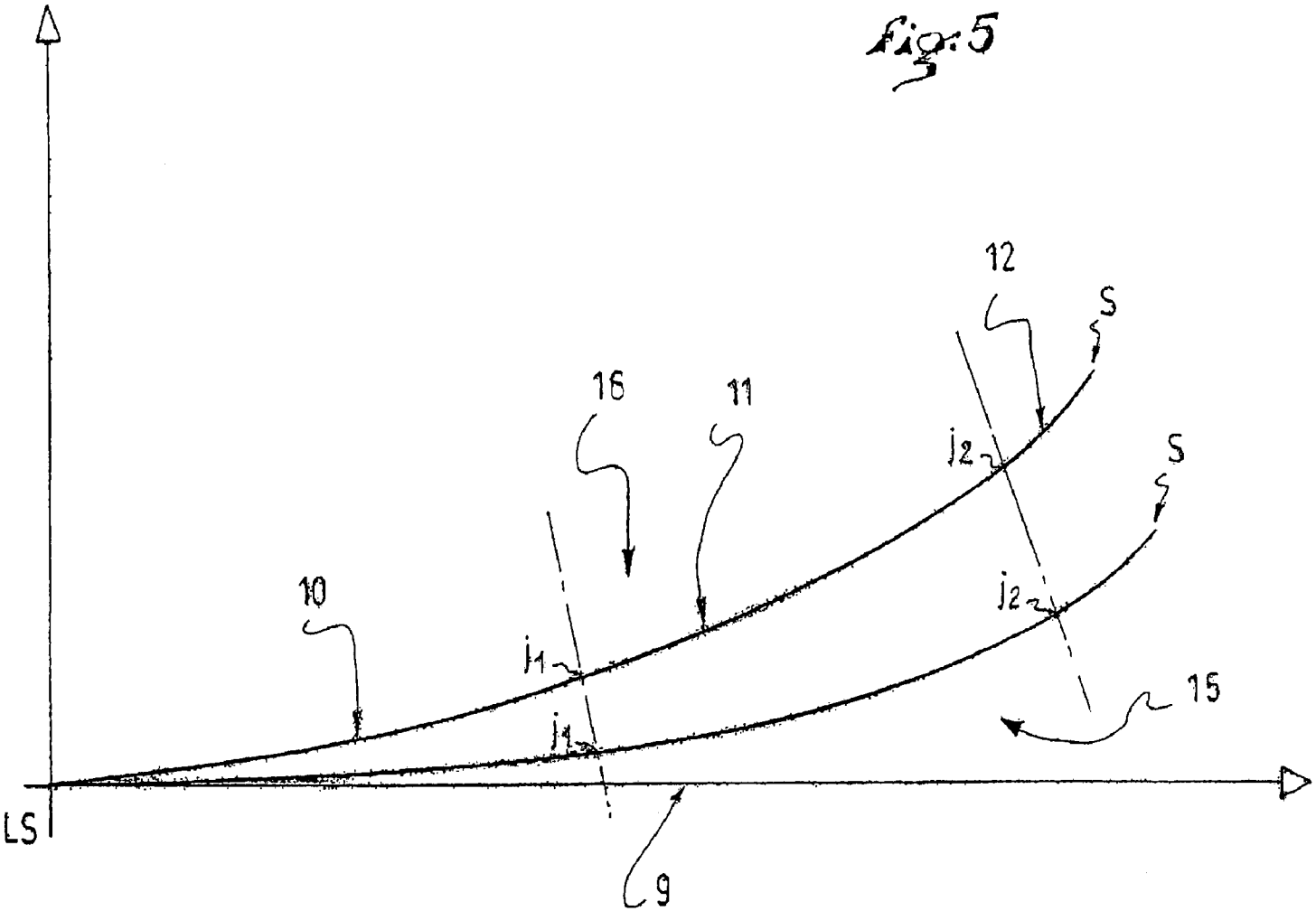
FIG. 5 shows the space into which the profile of the ski shovel fits according to the invention.

FIG. 5 shows the space into which the profile of the ski shovel fits according to a particular embodiment of the invention. In the graph of FIG. 5, the abscissa axis corresponds to the planar surface 9, whereas the ordinate axis corresponds to the height of the bottom surface of the ski from the planar surface 9. The bottom curve 15 corresponds to the profile of a shovel which, from the point LS up to the point J1, would have the convexity of a circular arc having a 9-meter radius, then, from the point J1 to the point J2, the convexity of a circular arc also having a 9-meter radius. The upper curve 16 corresponds to the profile of a shovel which, from the point LS to the point J1, would have the convexity of a circular arc having a 5-meter radius, then, from the point J1 to the point J2, the convexity of a circular arc having a 1-meter radius.

Any shovel profile whose first and second shovel portions, namely, the portions located between the points LS and J2, fit into the space demarcated by these two curves 15, 16 and which does not have "flat portions", corresponds to a shovel profile of the invention. The lack of a "flat portion" is established by the test of the "ski rolling movement in the area of the shovel". The ski is supported on a planar surface, lifted by the tail, namely the rear portion, then one observes that the contact between the bottom surface of the ski and the contact surface moves from the contact line LS to the tip S, and that during this displacement, contact is made between the ski and the contact surface only along one line. At no time does such contact become a plurality of lines, or a surface.

The lack of a "flat portion" is also observed on the curve reproducing the lateral profile of the shovel. The shovel is considered to have a "flat portion" if, when taking two points P1 and P2 of the curve, positioned between the points LS and S, separated from one another by a 150-mm chord distance, the curve between P1 and P2 never moves away from the chord joining P1 and P2 by a value greater than 0.5 mm.

Conversely, the shovel is considered to have no "flat portion" when, irrespective of the points P1 and P2 placed at a 150-mm chord distance from one another on the curve reproducing the shovel lateral profile, there is at least one point of the curve between P1 and P2 that is more than 0.5 mm distant from the chord joining P1 to P2. When one refers to the distance from the curve to the chord, one refers to the shortest distance, namely, the distance measured on the bisecting line from the chord to the point being considered.

Figure 6:
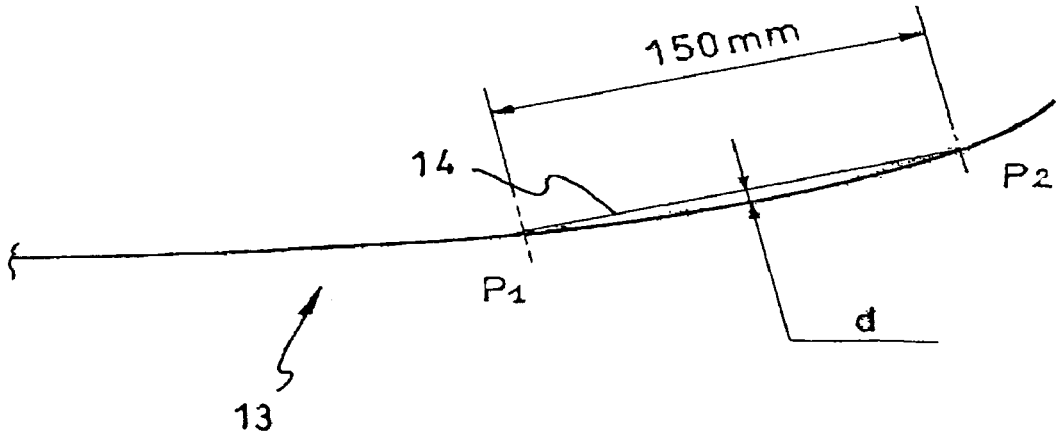
FIG. 6 shows the detail of the curve reproducing the lateral profile of the ski shovel according to the invention.

FIG. 6 shows the detail of the curve 13 reproducing the lateral profile of the ski shovel according to the invention. On this curve 13, two points P1 and P2 are placed at a 150-mm chord distance, namely, the length of the chord 14 joining the point P1 to the point P2 measures 150 mm. Given that, according to the invention, the shovel has no "flat portion", there is at least one point, positioned between P1 and P2, in the area of which the distance d that separates the curve 13 from the chord 14 is greater than 0.5 mm.

Conventionally, the tip height of a ski is measured by determining, at a point located 300 mm away from the front tip, the height H of the ski with respect to a planar surface on which it lies. The ski according to the invention has a high shovel since the height H is comprised between 5 mm and 25 mm.

The present invention is not limited to the embodiment hereinabove described, given only by way of example, but covers any equivalent embodiment.

LIST OF ELEMENTS

1—ski
2—toe piece
3—heel piece
4—boot
5—front tip of ski
6—rear end of ski
7—top surface of ski
8—bottom surface of ski
9—planar surface
10—first shovel portion
11—second shovel portion
12—third shovel portion
13—curve representing the shovel profile
14—chord
15—bottom curve
16—upper curve

The invention claimed is:

1. A ski adapted to support a user's boot, said ski comprising:

a front tip;

a rear end;

a central portion positioned between the front tip and the rear end;

the central portion, when positioned on a planar surface, forms at least two contact lines with said planar surface, said at least two contact lines comprising:

a front contact line positioned closer to the front tip than to the rear end;

a rear contact line positioned closer to the rear end than to the front tip;

a distance separating the front contact line from the front tip being greater than 500 millimeters;

a shovel extending from the front contact line to the front tip, said shovel comprising:

a first shovel portion having a lateral profile contained within a space between a first pair of circular arcs, said first pair of circular arcs being a first circular arc having a radius of 5 meters and a second circular arc having a radius of 9 meters, each of said first pair of circular arcs extending through a point of the front contact line and tangent to a lateral profile of said central portion;

a second shovel portion contiguous to said first shovel portion, said second shovel portion having a lateral profile contained within a space between a second pair of circular arcs, said second pair of circular arcs being a first circular arc having a radius of 1 meter and a second circular arc having a radius of 9 meters, each of said second pair of circular arcs extending through a forward end point of the lateral profile of the first shovel portion and tangent to the lateral profile of said first shovel portion.

2. A ski according to claim 1, wherein:

a height corresponding to a distance between said planar surface and the ski measured at a point 300 millimeters from the front tip of the ski is comprised between 5 millimeters and 25 millimeters.

3. A ski according to claim 1, wherein:

a distance between the rear contact line and the rear end of the ski is less than 300 millimeters.

4. A ski according to claim 1, wherein:

the lateral profile of the first shovel portion has no flat portion; and the lateral profile of the second shovel portion has no flat portion.

5. A ski according to claim 1, wherein:

between the front tip and the front contact line, maximum width of the shovel is between 125 mm and 170 mm.

6. A ski according to claim 1, wherein:

between the rear end and the rear contact line, maximum width of the tail is between 110 mm and 160 mm.

7. A ski according to claim 1, wherein:

the ski has a length of 1920 mm;

the shovel has a length of 730 mm.

8. A ski according to claim 1, wherein:

the ski has a length of 1920 mm;

the front contact line and the rear contact line are spaced apart by 1090 mm.

9. A ski according to claim 1, wherein:

the shovel has a maximum width located between 440 mm and 640 mm forward of the front contact line.

10. A ski according to claim 9, wherein:

the maximum width of the shovel is between 125 mm and 170 mm.

11. A ski according to claim 1, wherein:

the ski has a length L extending from the front tip to the rear end;

the shovel has a length DS extending from the front tip to the front contact line;

a ratio DS/L is within a range between about 0.26 and about 0.38.

12. A ski according to claim 1, wherein:

a boot support zone for receiving binding elements is positioned between the front and rear contact lines.

13. A ski according to claim 1, wherein:

between the front and rear contact lines the ski has a camber comprising a concave curvature.

14. A ski according to claim 1, wherein:

lines of maximum width of the ski comprises a front line forward of the front contact line and a rear line rearward of the rear contact line.

15. A ski adapted to support a user's boot, said ski comprising:

a front tip;

a rear end;

a central zone positioned between the front tip and the rear end;

the central zone, when positioned on a planar surface, forms at least two contact lines with said planar surface, said at least two contact lines comprising:

a front contact line positioned closer to the front tip than to the rear end;

a rear contact line positioned closer to the rear end than to the front tip;

a distance separating the front contact line from the front tip being greater than 500 millimeters;

a shovel extending from the front contact line to the front tip, said shovel having a convex zone comprising:

a first shovel portion having a lateral profile having a shape of a circular arc, said circular arc having a radius with a length between 5 meters and 9 meters;

a second shovel portion contiguous to said first shovel portion, said second shovel portion having a shape of a circular arc, said circular arc of said second shovel portion having a radius with a length between 1 meter and 9 meters;

a third shovel portion contiguous to said second shovel portion and extending to the front tip of the ski.

16. A ski according to claim 15, wherein:

the profile of the first shovel portion has no flat portion and of the profile of the second shovel portion has no flat portion.

17. A ski according to claim 15, wherein:

the shovel comprises a lateral profile, said lateral profile of said shovel comprises a curve, said curve comprising said profile of said first shovel portion and said profile of said second shovel portion;

for any pair of points on said curve of said lateral profile of said shovel spaced apart by a chord having a length of 150 millimeters, there is at least one point on said curve between said pair of points more than 0.5 millimeters away from said chord.

18. A ski according to claim 15, wherein:

said third shovel portion has a length between 80 millimeters and 130 millimeters.

19. A ski according to claim 15, wherein:

the radius of the circular arc of said second shovel portion is less than the radius of the circular arc of said first shovel portion.

20. A ski according to claim 15, wherein:

the ski has a length L extending from the front tip to the rear end;

the shovel has a length DS extending from the front tip to the front contact line;

a ratio DS/L is within a range between about 0.26 and about 0.38.

21. A ski according to claim 15, wherein:

a height corresponding to a distance between said planar surface and the ski, measured at a point 300 millimeters from the front tip of the ski, is between 5 millimeters and 25 millimeters.

22. A ski adapted to support a user's boot, said ski comprising:

a front tip;

a rear end;

a central zone positioned between the front tip and the rear end;

the central zone, when positioned on a planar surface, forms at least two contact lines with said planar surface, said at least two contact lines comprising:

a front contact line positioned closer to the front tip than to the rear end;

a rear contact line positioned closer to the rear end than to the front tip;

a distance separating the front contact line from the front tip is greater than 500 millimeters;

a shovel extending from the front contact line to the front tip, said shovel comprising:

a first shovel portion having a lateral profile having a shape of a circular arc, said circular arc having a radius with a length between 5 meters and 9 meters;

a second shovel portion forward of said first shovel portion, said second shovel portion having a shape of a circular arc, said circular arc of said second shovel portion having a radius with a length between 1 meter and 3 meters.

23. A ski according to claim 22, further comprising:

a third shovel portion forward of said second shovel portion, said third shovel portion having a shape of a circular arc, said third shovel portion having a length between 80 millimeters and 130 millimeters.

24. A ski comprising:

a front tip;

a rear end;

a front contact line;

a rear contact line;

the ski contacting a planar surface when supported on the planar surface at the front contact line and the rear contact line, while each of said front tip and said rear tip is spaced above said planar surface;

from the front tip to the rear end, the ski having a length L defined by:

a shovel having a length DS extending from the front tip to the front contact line;

a central zone extending from the front contact line to the rear contact line;

a tail extending from the rear contact line to the rear end;

a ratio DS/L within a range between approximately 0.26 and approximately 0.38.

25. A ski according to claim 24, wherein:

in a non-stressed state of the ski, the shovel comprises:

a first shovel portion having a lateral profile having a shape of a circular arc, said circular arc having a radius with a length between 5 meters and 9 meters;

a second shovel portion contiguous to said first shovel portion, said second shovel portion having a shape of a circular arc, said circular arc of said second shovel portion having a radius with a length between 1 meter and 9 meters;

a third shovel portion contiguous to said second shovel portion and extending to the front tip of the ski, the third shovel portion having a shape of a circular arc, said circular arc of said third shovel portion having a radius with a length less than the length of the radius of the circular arc of said second shovel portion.

26. A ski according to claim 25, wherein:

the radius of the circular arc of said second shovel portion is less than the radius of the circular arc of said first shovel portion.

27. A ski according to claim 24, wherein:

in a non-stressed state of the ski, the shovel comprises:

a first shovel portion having a lateral profile contained within a space between a first pair of circular arcs, said first pair of circular arcs being a first circular arc having a radius of 5 meters and a second circular arc having a radius of 9 meters, each of said first pair of circular arcs extending through a point of the front contact line and tangent to a lateral profile of said central portion;

a second shovel portion contiguous to said first shovel portion, said second shovel portion having a lateral profile contained within a space between a second pair of circular arcs, said second pair of circular arcs being a first circular arc having a radius of 1 meter and a second circular arc having a radius of 9 meters, each of said second pair of circular arcs extending through a forward end point of the lateral profile of the first shovel portion and tangent to the lateral profile of said first shovel portion.

28. A ski according to claim 27, wherein:

a height corresponding to a distance between said planar surface and the ski, measured at a point 300 millimeters from the front tip of the ski, is between 5 millimeters and 25 millimeters.

29. A ski comprising:

a front tip;

a rear end;

a front contact line;

a rear contact line;

the ski contacting a planar surface when supported in a non-stressed state on the planar surface at the front contact line and the rear contact line, while each of said front tip and said rear tip is spaced above said planar surface;

from the front tip to the rear end, the ski having a length L defined by:

a shovel having a length DS extending from the front tip to the front contact line, said length being greater than 500 millimeters;

a central zone extending from the front contact line to the rear contact line;

a tail extending from the rear contact line to the rear end;

a ratio DS/L within a range between approximately 0.26 and approximately 0.38;

in a non-stressed state of the ski, the shovel comprises:

a first shovel portion having a lateral profile with a radius of curvature between 5 and 9 meters and extending through a point of the front contact line and tangent to a lateral profile of said central portion;

a second shovel portion contiguous to said first shovel portion, said second shovel portion having a lateral profile with a radius of curvature between 1 and 9 meters and extending through a forward end point of the lateral profile of the first shovel portion and tangent to the lateral profile of said first shovel portion.

30. A ski according to claim 29, wherein:

a height corresponding to a distance between said planar surface and the ski, measured at a point 300 millimeters from the front tip of the ski, is between 5 millimeters and 25 millimeters.

31. A ski adapted to support a user's boot, said ski comprising:

a front tip;

a rear end;

a central portion positioned between the front tip and the rear end;

the central portion, when positioned on a planar surface, forms at least two contact lines with said planar surface, said at least two contact lines comprising:

a front contact line positioned closer to the front tip than to the rear end;

a rear contact line positioned closer to the rear end than to the front tip;

a distance separating the front contact line from the front tip being greater than 500 millimeters;

a bottom edge structured and arranged to come into gripping engagement with snow during edging of the ski in a turn, said bottom edge comprising a running edge extending between the front and rear contact lines;

means for increasing a length of edge-gripping snow engagement as soon as the turn is initiated to be greater than the length of the running edge between the front and rear contact lines, said means comprising:

lines of maximum width of the ski comprising a front line forward of the front contact line and a rear line rearward of the rear contact line;

a shovel extending from the front contact line to the front tip, said shovel comprising a first shovel portion having a lateral profile between a first pair of circular arcs, said first pair of circular arcs being a first circular arc having a radius of 5 meters and a second circular arc having a radius of 9 meters, each of said first pair of circular arcs extending through a point of the front contact line and tangent to a lateral profile of said central portion;

a second shovel portion contiguous to said first shovel portion, said second shovel portion having a lateral profile between a second pair of circular arcs, said second pair of circular arcs being a first circular arc having a radius of 1 meter and a second circular arc having a radius of 9 meters, each of said second pair of circular arcs extending through a forward end point of the lateral profile of the first shovel portion and tangent to the lateral profile of said first shovel portion.

* * * * *